US009251693B2

(12) United States Patent
Edwards

(10) Patent No.: US 9,251,693 B2
(45) Date of Patent: Feb. 2, 2016

(54) PROVIDING NOTIFICATION THAT AN ELECTRONIC DEVICE IS LOCATED AT A VEHICLE

(71) Applicant: General Motors LLC, Detroit, MI (US)

(72) Inventor: Ryan M. Edwards, Macomb, MI (US)

(73) Assignee: General Motors LLC, Detroit, MI (US)

( * ) Notice: Subject to any disclaimer, the term of this patent is extended or adjusted under 35 U.S.C. 154(b) by 83 days.

(21) Appl. No.: 13/974,691

(22) Filed: Aug. 23, 2013

(65) Prior Publication Data

US 2015/0054647 A1 Feb. 26, 2015

(51) Int. Cl.
*G08B 13/14* (2006.01)
*G08B 21/22* (2006.01)

(52) U.S. Cl.
CPC ..... *G08B 21/22* (2013.01)

(58) Field of Classification Search
CPC ..... G02B 2027/012; G02B 27/01; G02B 27/0101; G02B 6/00; G08G 1/09; G08G 1/142; G08G 1/161; G08G 9/02; G08G 1/207; G08G 1/127; G08G 1/20; H04N 5/2253; H04N 7/18; H04W 4/046; H04W 4/06
USPC ..... 340/568.1, 552, 555, 567, 568.2, 340/572.1–572.9, 571, 588, 566, 539.21, 340/539.13, 539.26
See application file for complete search history.

(56) References Cited

U.S. PATENT DOCUMENTS

2003/0158641 A1* 8/2003 Dickinson et al. ..... 701/41
2009/0210302 A1* 8/2009 Tashev et al. ..... 705/14
2013/0038432 A1* 2/2013 Grost ..... G08B 13/1427 340/425.5
2013/0083722 A1* 4/2013 Bhargava et al. ..... 370/315
2013/0288675 A1* 10/2013 Gassend ..... 455/434

FOREIGN PATENT DOCUMENTS

JP 2009020731 * 1/2009
JP 02009020731 * 1/2009

* cited by examiner

*Primary Examiner* — Daniel Previl
(74) *Attorney, Agent, or Firm* — Anthony L. Simon; Reising Ethington P.C.

(57) ABSTRACT

A method of providing an alert that a portable electronic device has been left at a vehicle. The method comprises determining that an occupant has exited the vehicle. The method further comprises detecting that a portable electronic device is located at the vehicle. When it has been determined that the occupant has left the vehicle and that the electronic device has been left behind, the method still further comprises generating an alert to notify the occupant that the electronic device has been left at the vehicle. A system for performing or utilizing the above-described methodology is also provided.

20 Claims, 2 Drawing Sheets

PROVIDING NOTIFICATION THAT AN ELECTRONIC DEVICE IS LOCATED AT A VEHICLE

TECHNICAL FIELD

The present invention relates generally to vehicle telematics services and, more specifically, to providing alerts that a portable electronic device is located at a vehicle after an occupant (e.g., the driver) has exited the vehicle.

BACKGROUND

Modern vehicles may include systems or devices configured to provide telematics and/or infotainment services and having the capability of communicating with portable electronic devices (e.g., telephones, smart phones, tablets, personal digital assistants (PDA), computers, etc.) located within the vehicle. Such communication may be facilitated through hardwired connections (e.g., the portable devices may be electrically connected to an electromechanical port of the system or device via one or more wires or cables) or wireless connections (e.g., personal area networks (e.g., Bluetooth) or wireless local area networks (e.g., Wi-Fi)). In any event, when enabled, this communication capability may allow for the hands-free use of a suitably-configured electronic device by an occupant of the vehicle even though the device may not be within reach of, or in relatively close proximity to, the occupant, among potentially other functionality.

SUMMARY

According to an embodiment of the invention, there is provided a method of providing an alert that a portable electronic device has been left at a vehicle. The method comprises determining that an occupant has exited the vehicle, detecting that a portable electronic device is located at the vehicle, and generating an alert to notify the occupant that the electronic device has been left at the vehicle.

In accordance with another aspect of the invention, there is provided a system for providing an alert that a portable electronic device has been left at a vehicle. The system comprises an electronic processing device that is configured to determine that an occupant has exited the vehicle, detect that a portable electronic device is located at the vehicle, and generate an alert to notify the occupant that the electronic device has been left at the vehicle.

BRIEF DESCRIPTION OF THE DRAWINGS

One or more embodiments of the invention will hereinafter be described in conjunction with the appended drawings, wherein like designations denote like elements, and wherein.

DETAILED DESCRIPTION OF THE ILLUSTRATED EMBODIMENT(S)

The method and system described below may be used to provide one or more alerts that a portable electronic device is located at a vehicle. Such alerts may be useful to a vehicle occupant (e.g., the driver) who has exited the vehicle but inadvertently left behind a portable electronic device, such as, for example, a mobile telephone, smart phone, tablet, PDA, computer, etc. Accordingly, instead of the occupant realizing that the electronic device was left at the vehicle only after s/he has reached his/her destination—which may be a relatively long distance from the place where the vehicle is parked—or has gotten a relatively far distance way from the vehicle, the occupant is notified of this fact within a short period of time from when s/he exited the vehicle so that the device may be retrieved.

Figure 1:
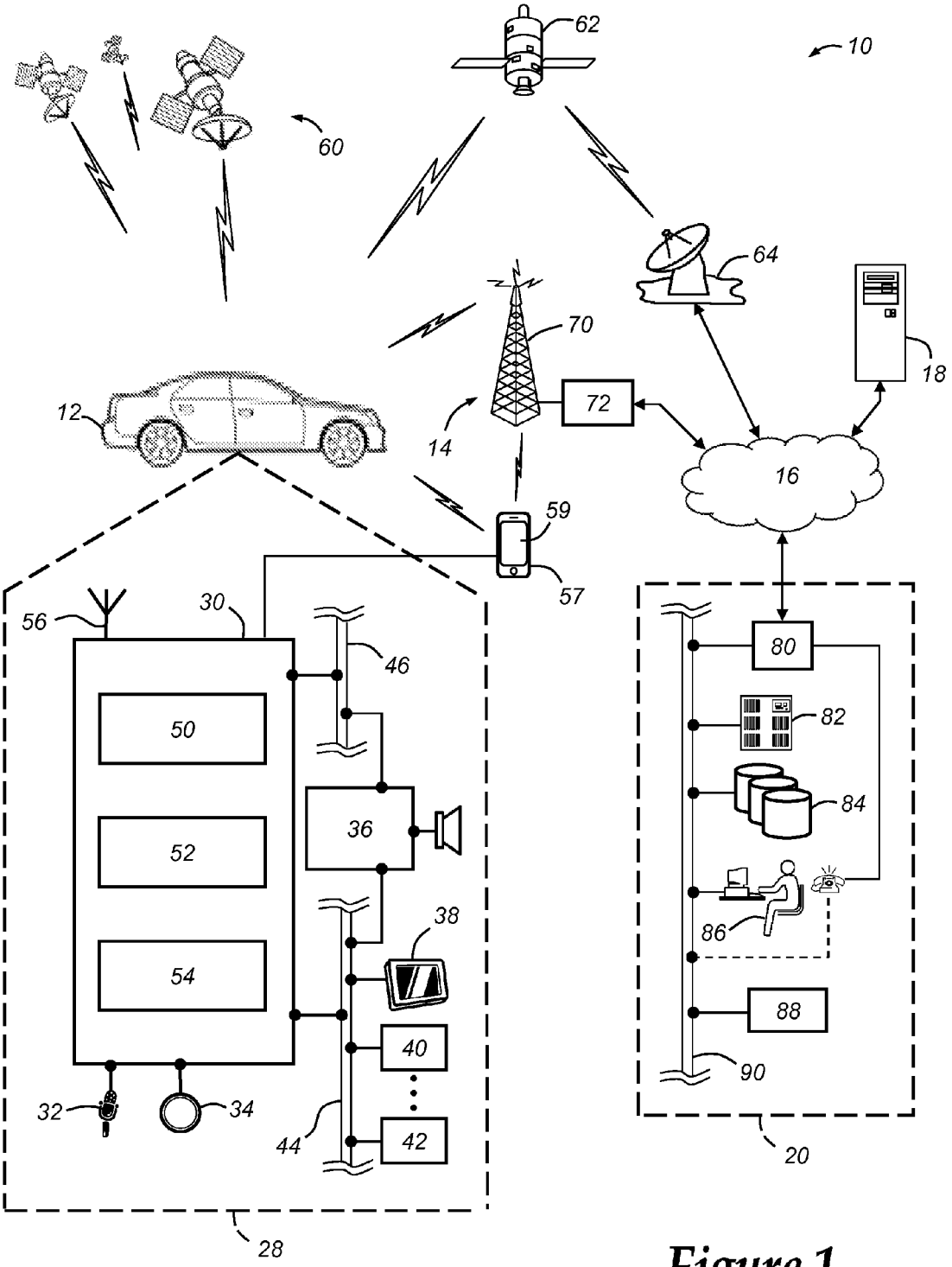
FIG. 1 is a block diagram depicting an embodiment of a communications system that is capable of utilizing or performing the method disclosed herein.

With reference to FIG. 1, there is shown an operating environment that comprises a mobile vehicle communications system 10 and that can be used to implement the method disclosed herein. Communications system 10 generally includes a vehicle 12, one or more wireless carrier systems 14, a land communications network 16, a computer 18, and a call center 20. It should be understood that the disclosed method can be used with any number of different systems and is not specifically limited to the operating environment shown here. Also, the architecture, construction, setup, and operation of the system 10 and its individual components are generally known in the art. Thus, the following paragraphs simply provide a brief overview of one such communications system 10; however, other systems not shown here could employ the disclosed method as well.

Vehicle 12 is depicted in the illustrated embodiment as a passenger car, but it should be appreciated that any other vehicle including motorcycles, trucks, sports utility vehicles (SUVs), recreational vehicles (RVs), marine vessels, aircraft, etc., can also be used. Some of the vehicle electronics 28 is shown generally in FIG. 1 and includes a telematics unit 30, a microphone 32, one or more pushbuttons or other control inputs 34, an audio system 36, a visual display 38, and a GPS module 40 as well as a number of vehicle system modules (VSMs) 42. Some of these devices can be connected directly to the telematics unit such as, for example, the microphone 32 and pushbutton(s) 34, whereas others are indirectly connected using one or more network connections, such as a communications bus 44 or an entertainment bus 46. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

Telematics unit 30 can be an OEM-installed (embedded) or aftermarket device that is installed in the vehicle and that enables wireless voice and/or data communication over wireless carrier system 14 and via wireless networking. This enables the vehicle to communicate with call center 20, other telematics-enabled vehicles, or some other entity or device. Telematics unit 30 preferably uses radio transmissions to establish a communications channel (a voice channel and/or a data channel) with wireless carrier system 14 so that voice and/or data transmissions can be sent and received over the channel. By providing both voice and data communication, telematics unit 30 enables vehicle 12 to offer a number of different services including those related to navigation, telephony, emergency assistance, diagnostics, infotainment, etc. Data can be sent either via a data connection, such as via packet data transmission over a data channel, or via a voice channel using techniques known in the art. For combined services that involve both voice communication (e.g., with a live advisor or voice response unit at the call center 20) and data communication (e.g., to provide GPS location data or vehicle diagnostic data to the call center 20), the system can utilize a single call over a voice channel and switch as needed between voice and data transmission over the voice channel, and this can be done using techniques known to those skilled in the art.

According to one embodiment, telematics unit 30 utilizes cellular communication according to either GSM or CDMA standards and thus includes a standard cellular chipset 50 for voice communications like hands-free calling, a wireless modem for data transmission, an electronic processing device 52, one or more digital memory devices 54, and a dual antenna 56. It should be appreciated that the modem can either be implemented through software that is stored in telematics unit 30 (e.g., memory device 54) and is executed by processor 52, or it can be a separate hardware component located internal or external to telematics unit 30. The modem can operate using any number of different standards or protocols such as EVDO, CDMA, GPRS, and EDGE. Wireless networking between the vehicle and other networked devices can also be carried out using telematics unit 30. For this purpose, telematics unit 30 can be configured to communicate wirelessly according to one or more wireless protocols, such as any of the IEEE 802.11 protocols, WiMAX, or Bluetooth. When used for packet-switched data communication such as TCP/IP, the telematics unit can be configured with a static IP address or can set up to automatically receive an assigned IP address from another device on the network such as a router or from a network address server.

One of the networked devices that can communicate with the telematics unit 30 is a portable or mobile electronic device 57, such as, for example, a mobile telephone, a smart phone, a tablet, a personal digital assistant (PDA), a laptop computer, a pager, or any other suitable device configured to be networked with the telematics unit 30. For purposes of illustration and clarity, the description below will be primarily with respect to electronic device 57 communicating with the telematics unit 30 and comprising a smart phone (i.e., "smart phone 57"), though the present disclosure is not meant to be so limited. Rather, in other embodiments, electronic device 57 may be other than a smart phone and/or it may be configured to communicate with a vehicle device or system in addition to or instead of telematics unit 30 (e.g., an infotainment module that may be separate and distinct from telematics unit 30, a radio, a human-machine-interface (HMI) module, a center stack module, or any other suitable configured module or device) for purposes of performing the method described below.

Smart phone 57 may include computer processing capability, a transceiver capable of communicating using a short-range wireless protocol, and a visual smart phone display 59. In some implementations, smart phone display 59 also includes a touch-screen graphical user interface and/or a GPS module capable of receiving GPS satellite signals and generating GPS coordinates based on those signals. Examples of smart phone 57 include the iPhone™ manufactured by Apple, Inc. and the Android™ manufactured by Motorola, Inc. as well as others.

While the description above relates to the wireless networking and communication between smart phone 57 and telematics unit 30, in an embodiment, smart phone 57 may additionally or alternatively be electrically connected to, and configured for communication with, telematics unit 30 via a wired connection. In such an embodiment, smart phone 57 may be electrically connected to telematics unit 30, either directly or indirectly, via an electromechanical port (not shown) located within vehicle 12 (e.g., in the center console or glove compartment of the vehicle, on the dashboard, etc.). More specifically, smart phone 57 can be connected via wire from its data connection to the electromechanical port, which may be a port of the telematics units 30 or electrically connected thereto through one or more network connections, such as those described above (e.g., communications bus 44 or entertainment bus 46). In any event, the electromechanical port may comprise any suitable port known in the art, including, but not limited to, a universal serial bus (USB) port, a RS232 port, and a RS485 port. Accordingly, depending on the particular implementation of the system 10, the electrical connection between smart phone 57 and telematics unit 30 may be a wired and/or wireless electrical connection.

Turning back to telematics unit 30, processor 52 of telematics unit 30 can be any type of device capable of processing electronic instructions including microprocessors, microcontrollers, host processors, controllers, vehicle communication processors, and application specific integrated circuits (ASICs). It can be a dedicated processor used only for telematics unit 30 or can be shared with other vehicle systems. Processor 52 executes various types of digitally-stored instructions, such as software or firmware programs stored in memory 54, which enable telematics unit 30 to provide a wide variety of services. For instance, processor 52 can execute programs or process data to carry out at least a part of the method discussed herein.

Telematics unit 30 can be used to provide a diverse range of vehicle services, some of which involve wireless communication to and/or from the vehicle. These services may include, for example: turn-by-turn directions and other navigation-related services that are provided in conjunction with the GPS-based vehicle navigation module 40; airbag deployment notification and other emergency or roadside assistance-related services that are provided in connection with one or more collision sensor interface modules such as a body control module (not shown); diagnostic reporting using one or more diagnostic modules; and infotainment-related services where music, webpages, movies, television programs, videogames and/or other information is downloaded by an infotainment module (not shown) and is stored for current or later playback. An additional service that telematics unit 30 can be used to provide and that will be described in greater detail below comprises providing an alert or notification that an electronic device, such as smart phone 57, has been left in the vehicle after an occupant has exited the vehicle. It will be appreciated that the above-identified services are by no means an exhaustive list of all of the capabilities of telematics unit 30, but are simply an enumeration of some of the services that the telematics unit is capable of offering. Furthermore, it should be understood that at least some of the aforementioned modules could be implemented in the form of software instructions saved internal or external to telematics unit 30, they could be hardware components located internal or external to telematics unit 30, or they could be integrated and/or shared with each other or with other systems located throughout the vehicle, to cite but a few possibilities. In the event that the modules are implemented as VSMs 42 located external to telematics unit 30, they could utilize vehicle bus 44 to exchange data and commands with the telematics unit.

GPS module 40 receives radio signals from a constellation 60 of GPS satellites. From these signals, module 40 can determine vehicle position that is used for providing navigation and other position-related services to the vehicle driver. Navigation information can be presented on display 38 (or other display within the vehicle) or can be presented verbally such as is done when supplying turn-by-turn navigation. The navigation services can be provided using a dedicated in-vehicle navigation module (which can be part of GPS module 40), or some or all navigation services can be done via telematics unit 30, wherein the position information is sent to a remote location for purposes of providing the vehicle with navigation maps, map annotations (points of interest, restaurants, etc.), route calculations, and the like. The position information can be supplied to call center 20 or other remote computer system, such as computer 18, for other purposes, such as fleet management. Also, new or updated map data can be downloaded to GPS module 40 from call center 20 via telematics unit 30.

Apart from audio system 36 and GPS module 40, vehicle 12 can include other vehicle system modules (VSMs) 42 in the form of electronic hardware components that are located throughout the vehicle and typically receive input from one or more sensors and use the sensed input to perform diagnostic, monitoring, control, reporting and/or other functions. Each of the VSMs 42 is preferably connected by communications bus 44 to the other VSMs, as well as to telematics unit 30, and can be programmed to run vehicle system and subsystem diagnostic tests. One VSM 42 may be an engine control module (ECM) that controls various aspects of engine operation such as fuel ignition and ignition timing. Another VSM 42 may be a powertrain control module that regulates operation of one or more components of the vehicle powertrain. Yet another VSM 42 can be a body control module that governs various electrical components located throughout the vehicle, like the vehicle's power door locks, horn, and lights (e.g., headlights, brake lights, interior lights, etc.). In an embodiment wherein vehicle 12 is equipped with a keyless electronic access and authorization system, another VSM 42 may be an electronic access and authorization module that is configured to determine, for example, when a smart key for the vehicle that is external thereto is within a particular distance therefrom, when the smart key is located within the vehicle, etc. Alternatively, instead of vehicle 12 including a dedicated access and authorization module, this functionality may be performed by the body control module or another VSM 42. As is appreciated by those skilled in the art, the above-mentioned VSMs are only examples of some of the modules that may be used in vehicle 12, as numerous others are also possible.

In any event, as briefly described above, VSMs 42 of vehicle 12 may be configured to perform a reporting function. More particularly, in an embodiment, one or more of the VSMs 42 is/are configured to provide various types of information to telematics unit 30 relating to the operational state of vehicle 12 and/or certain systems thereof, some or all of which may be used in the performance of the method described below. For example, real-time information relating to the operational state of the vehicle engine (i.e., the engine is "on" or "off") may be provided to telematics unit 30 by the ECM, the body control module, or another VSM 42. Real-time information relating to the state of the vehicle door locks (i.e., "locked" or "unlocked") may be provided to telematics unit 30 by the body control module, the access and authorization module, or another VSM. Similarly, and if applicable, real-time information relating to the location of a smart key for the vehicle 12 (i.e., the smart key is located inside or outside of the vehicle) may be provided to telematics unit 30 by the body control module or the separate and distinct access and authorization module. It will be appreciated that the above-mentioned information are only examples of some of the possible types of information that may be provided to telematics unit 30, as numerous other types of information are also possible. In any event, the information may be communicated to telematics unit 30 in response to a query or request received from telematics unit 30, automatically in accordance with a predetermined sampling or reporting rate or upon the occurrence of a particular trigger event, or according to any other suitable reporting scheme.

Vehicle electronics 28 also includes a number of vehicle user interfaces that provide vehicle occupants with a means of providing and/or receiving information, including microphone 32, pushbuttons(s) 34, audio system 36, and visual display 38. As used herein, the term 'vehicle user interface' broadly includes any suitable form of electronic device, including both hardware and software components, which is located on vehicle 12 and enables a vehicle user to communicate with or through a component of vehicle 12. Microphone 32 provides audio input to the telematics unit to enable the driver or other occupant to provide voice commands and carry out hands-free calling via the wireless carrier system 14. Alternatively, microphone 32 may provide audio input to the telematics unit to enable the driver or other occupant to provide voice commands and carry out hands-free calling and other functionality (e.g., hands-free text messaging) via the wireless carrier network to which smart phone 57 is connected, which may or may not comprise wireless carrier system 14. For these purposes, microphone 32 can be connected to an on-board automated voice processing unit utilizing human-machine interface (HMI) technology known in the art. Pushbutton(s) 34 allow manual user input into the telematics unit 30 to initiate wireless telephone calls and provide other data, response, or control input. Separate pushbuttons can be used for initiating emergency calls versus regular service assistance calls to call center 20. Audio system 36 provides audio output to a vehicle occupant and can be a dedicated, stand-alone system or part of the primary vehicle audio system. According to the particular embodiment shown here, audio system 36 is operatively coupled to both vehicle bus 44 and entertainment bus 46 and can provide AM, FM and satellite radio, CD, DVD and other multimedia functionality. This functionality can be provided in conjunction with or independent of the infotainment module described above. Visual display 38 is preferably a graphics display, such as a touch screen on the instrument panel or a heads-up display reflected off of the windshield, and can be used to provide a multitude of input and output functions. Various other vehicle user interfaces can also be utilized, as the interfaces of FIG. 1 are only an example of one particular implementation.

Wireless carrier system 14 is preferably a cellular telephone system that includes a plurality of cell towers 70 (only one shown), one or more mobile switching centers (MSCs) 72, as well as any other networking components required to connect wireless carrier system 14 with land network 16. Each cell tower 70 includes sending and receiving antennas and a base station, with the base stations from different cell towers being connected to the MSC 72 either directly or via intermediary equipment such as a base station controller. Cellular system 14 can implement any suitable communications technology, including for example, analog technologies such as AMPS, or the newer digital technologies such as CDMA (e.g., CDMA2000) or GSM/GPRS. As will be appreciated by those skilled in the art, various cell tower/base station/MSC arrangements are possible and could be used with wireless system 14. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 14, a different wireless carrier system in the form of satellite communication can be used to provide uni-directional or bi-directional communication with the vehicle. This can be done using one or more communication satellites 62 and an uplink transmitting station 64. Uni-directional communication can be, for example, satellite radio services, wherein programming content (news, music, etc.) is received by transmitting station 64, packaged for upload, and then sent to the satellite 62, which broadcasts the programming to subscribers. Bi-directional communication can be, for example, satellite telephony services using satellite 62 to relay telephone communications between the vehicle 12 and station 64. If used, this satellite telephony can be utilized either in addition to or in lieu of wireless carrier system 14.

Land network 16 may be a conventional land-based telecommunications network that is connected to one or more landline telephones and connects wireless carrier system 14 to call center 20. For example, land network 16 may include a public switched telephone network (PSTN) such as that used to provide hardwired telephony, packet-switched data communications, and the Internet infrastructure. One or more segments of land network 16 could be implemented through the use of a standard wired network, a fiber or other optical network, a cable network, power lines, other wireless networks such as wireless local area networks (WLANs), or networks providing broadband wireless access (BWA), or any combination thereof. Furthermore, call center 20 need not be connected via land network 16, but could include wireless telephony equipment so that it can communicate directly with a wireless network, such as wireless carrier system 14.

Computer 18 can be one of a number of computers accessible via a private or public network such as the Internet. Each such computer 18 can be used for one or more purposes, such as a web server accessible by the vehicle via telematics unit 30 and wireless carrier 14. Other such accessible computers 18 can be, for example: a service center computer where diagnostic information and other vehicle data can be uploaded from the vehicle via the telematics unit 30; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with vehicle 12 or call center 20, or both. A computer 18 can also be used for providing Internet connectivity such as DNS services or as a network address server that uses DHCP or other suitable protocol to assign an IP address to vehicle 12.

Call center 20 is designed to provide the vehicle electronics 28 with a number of different system back-end functions and, according to the exemplary embodiment shown here, generally includes one or more switches 80, servers 82, databases 84, live advisors 86, as well as an automated voice response system (VRS) 88, all of which are known in the art. These various call center components are preferably coupled to one another via a wired or wireless local area network 90. Switch 80, which can be a private branch exchange (PBX) switch, routes incoming signals so that voice transmissions are usually sent to either the live adviser 86 by regular phone or to the automated voice response system 88 using VoIP. The live advisor phone can also use VoIP as indicated by the broken line in FIG. 1. VoIP and other data communication through the switch 80 is implemented via a modem (not shown) connected between the switch 80 and network 90. Data transmissions are passed via the modem to server 82 and/or database 84. Database 84 can store account information such as subscriber authentication information, vehicle identifiers, profile records, behavioral patterns, and other pertinent subscriber information. Data transmissions may also be conducted by wireless systems, such as 802.11x, GPRS, and the like. Although the illustrated embodiment has been described as it would be used in conjunction with a manned call center 20 using live advisor 86, it will be appreciated that the call center can instead utilize VRS 88 as an automated advisor or, a combination of VRS 88 and the live advisor 86 can be used.

Method—

Figure 2:
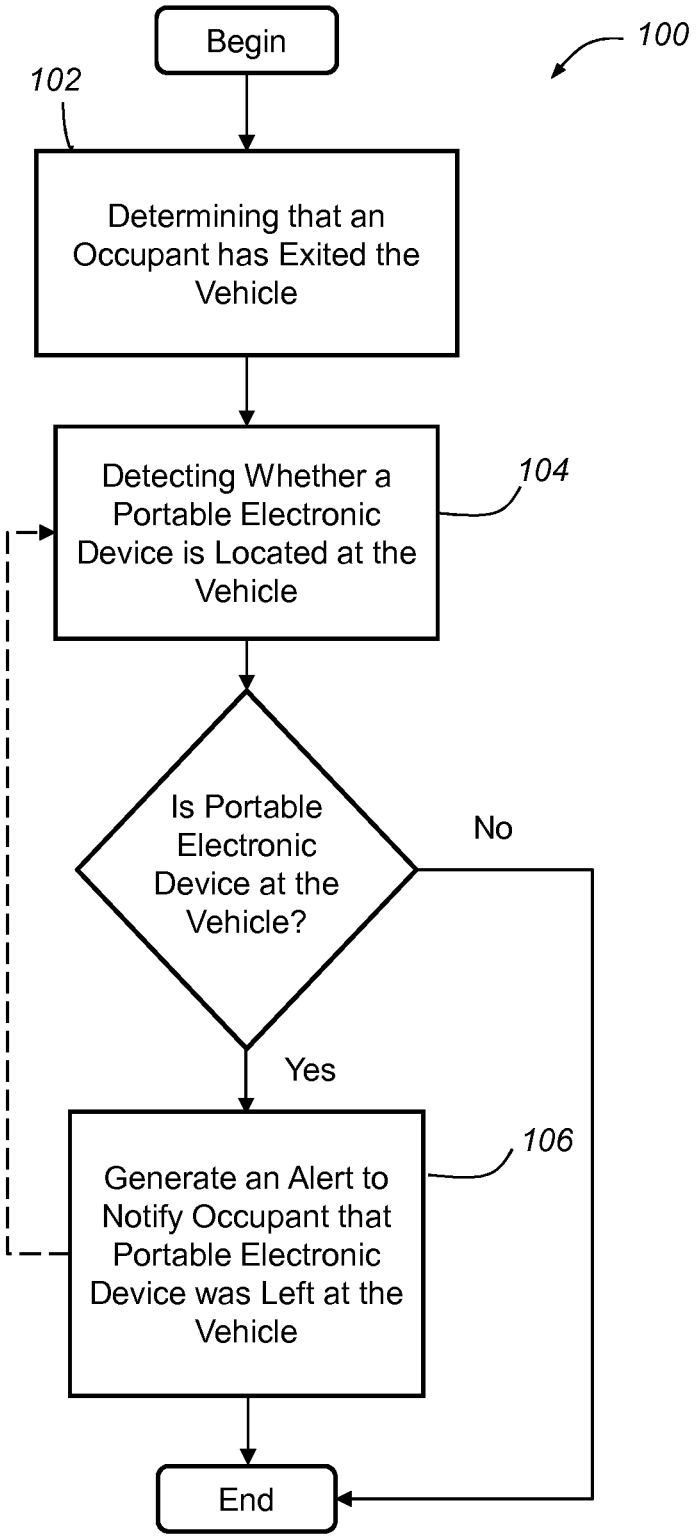
FIG. 2 is a flow chart depicting an embodiment of a method of providing an alert that a portable electronic device has been left in a vehicle.

Turning now to FIG. 2, there is shown a method 100 of providing an alert or notification that a portable electronic device has been left at a vehicle. This may include, for instance, the electronic device being left inside the vehicle, such as, for example, in the passenger compartment, trunk, glove compartment, center console, etc. of the vehicle. This may also include the electronic device being left in close proximity to the vehicle, or to a particular component thereof (e.g., telematics unit 30), such as, for example, within a certain distance from the vehicle or vehicle component (i.e., on the order of meters (e.g., 0-5 meters)), which may, in turn, include instances wherein the electronic device is left on or at a certain location of the vehicle, for example, the roof, tailgate, bumper, or any other place on or near the vehicle where a person could leave such a device.

In an embodiment, method 100 comprises a step 102 of determining that one or more occupants (e.g., the driver) has/have exited the vehicle. Step 102 may be performed in a number of ways. For example, in one embodiment, step 102 comprises determining that the occupant (or all occupants) has exited the vehicle in response to the occurrence of a predetermined event. This event may include any number of events, such as, for example, the vehicle engine being turned off, the vehicle doors being locked, a smart key for the vehicle being removed from the vehicle, and the sensing by the vehicle electronics 28 (e.g., telematics unit 30, a VSM 42, etc.) that the occupant has exited the vehicle (e.g., via a reading of one or more sensors disposed in one or more of the vehicle seats or otherwise, as is known in the art), to cite a few possibilities. In certain instances, the predetermined event may comprise a combination of events. For example, in an embodiment, the predetermined event may comprise the combination of the vehicle engine being turned off and a predetermined period of time elapsing without the engine being re-started or the occupant re-entering the vehicle, the combination of the engine being turned off and the doors being locked, etc. Accordingly, it will be appreciated that the present disclosure is not limited to the use of any particular event(s) for the purpose of performing step 102; rather any number or combination of events may be taken into consideration in determining whether or not an occupant has exited the vehicle.

Step 102 may be performed by the electronics 28 of vehicle 12, and telematics unit 30 (e.g., electronic processing device 52), one or more VSMs 42, and/or a combination of telematics unit 30 and one or more VSMs 42, in particular. In an embodiment, telematics unit 30 is configured to perform step 102 based on information received from one or more VSMs 42. For example, in an embodiment wherein step 102 comprises determining that the occupant has left the vehicle based at least in part on the engine of vehicle 12 being turned off, the telematics unit 30 may receive information from one or more appropriate VSMs 42, such as, for example, the ECM or the body control module, notifying telematics unit 30, or allowing it to determine, that the engine has been turned off. In an embodiment wherein the determination of step 102 is based at least in part on the vehicle doors being locked, the telematics unit 30 may receive information from one or more appropriate VSMs 42, such as, for example, the body control module, notifying telematics unit 30, or allowing it to determine, that the doors of the vehicle have been locked. In an embodiment wherein the determination of step 102 is based at least in part on a smart key for the vehicle being removed from the vehicle, the telematics unit 30 may receive information from one or more appropriate VSMs 42, such as, for example, the body control module or, if applicable, the electronic access and authorization module, notifying telematics unit 30, or allowing it to determine, that the smart key is outside the boundaries of the vehicle. Regardless of the particular type and source of the information, it may be: automatically transmitted (in real-time or substantially real-time) to telematics unit 30 upon the VSM 42 detecting that one or more particular event(s) has/have occurred (e.g., the engine has been turned off) or as part of an established reporting scheme wherein the operational status of one or more vehicle components is continuously or periodically reported to telematics unit 30; transmitted in response to a query or request to do so received from telematics unit 30; or it may be transmitted or communicated to telematics unit 30 in any other suitable manner. Further, in an embodiment wherein the determination made in step 102 also includes a temporal component such as a predetermined amount of time (e.g., a matter of seconds to a matter of minutes) having elapsed since the occurrence of a particular event (e.g., the engine of the vehicle being turned off without the engine being re-started or the occupant re-entering the vehicle), telematics unit 30 may further include a timer means to determine if and when the predetermined amount of time has elapsed, and to make the determination of whether the occupant has exited the vehicle accordingly.

If it is determined in step 102 that the occupant has exited the vehicle, method 100 moves to a step 104 comprising detecting whether a portable electronic device (e.g., electronic device 57 described above) is located at the vehicle, which, as described above, may include the device being located within the vehicle or a compartment thereof, or at least in close proximity to the vehicle or a component thereof. Step 104 may be performed by the vehicle electronics 28 and, in an embodiment, telematics unit 30 (i.e., electronic processing device 52), in particular, and may be done so in a number of ways, depending at least in part on the existence and nature of an electrical connection between the electronic device 57 and a device of the vehicle (e.g., telematics unit 30).

For example, in an embodiment wherein electronic device 57 is configured to be electrically connected to telematics unit 30 over a wired connection through, for instance, an electromechanical port located within vehicle 12, step 104 may comprise determining whether the electronic device is electrically connected to the port. Techniques for determining or detecting whether an electronic device is connected to an electromechanical port are well known in the art, and therefore, will not be described in detail here. To summarize one example, however, telematics unit 30 may be configured to detect the existence of a power load on the port. The presence of such a load is indicative of the electronic device 57 being present or connected, while the absence of such a load is indicative of the electronic device 57 being absent or not connected. If it is determined that electronic device 57 is in fact connected to the port, it can be further determined or detected that electronic device 57 is located at (e.g., within) vehicle 12.

In an embodiment wherein electronic device 57 is additionally or alternatively configured to be electrically connected to telematics unit 30 over a wireless connection or link, as was described in greater detail above, step 104 may comprise evaluating the existence and/or strength of the wireless connection between electronic device 57 and telematics unit 30. More particularly, step 104 may comprise simply determining whether there is a wireless connection between electronic device 57 and telematics unit 30. In such an embodiment, if it is determined that there is a wireless connection, it can be further determined or detected that electronic device 57 is located at vehicle 12 (e.g., within or in close proximity to vehicle 12). Alternatively, if no connection is detected, it can be determined or detected that electronic device 57 is not located at vehicle 12.

In another embodiment, the relative strength of the wireless connection between electronic device 57 and telematics unit 30 may be used in step 104 to detect or determine whether device 57 is located at vehicle 12. For example, in one embodiment, telematics unit 30 may acquire a measurement of the signal strength of the wireless connection and compare it to a predetermined threshold value that corresponds to a minimum signal strength a signal between electronic device 57 and telematics unit 30 could have with electronic device 57 still being within the vehicle, or a least within a certain distance from the vehicle or a component thereof (e.g., telematics unit 30). In such an embodiment, telematics unit 30 may be configured to acquire the measured signal strength by measuring it itself or obtaining it from a memory device thereof (e.g., memory device 54), or by obtaining it from another component of the vehicle electronics 28. Additionally, the threshold signal strength value may be empirically derived as part of the design, manufacture, or installation of system 10 or telematics unit 30 thereof, in particular, and programmed into in a memory device of telematics unit 30 (e.g., memory 54) or in another memory device that is accessible thereby. In any event, if the acquired measurement is greater than (or, in at least one embodiment, equal to or greater than) the threshold value, telematics unit 30 can determine or detect that electronic device 57 is located at vehicle 12 (e.g., within or in close proximity to vehicle 12). If, however, the acquired measurement is less than (or, in at least one embodiment, equal to or less than) the threshold value, telematics unit 30 can determine or detect that electronic device 57 is not located at vehicle 12. It will be appreciated that the present disclosure is not limited to any one particular threshold value; rather, it is contemplated that any number of different threshold values may be used, including, for example, those based at least in part on the particular implementation of system 10 and/or the particular type of device that electronic device 57 comprises. In yet another embodiment, telematics unit 30 may be configured to perform step 104 by acquiring and comparing multiple signal strength measurements. More specifically, telematics unit 30 may acquire a first measurement of the signal strength of the wireless connection between it and electronic device 57 corresponding to a time at which a certain event occurs or a predetermined period of time thereafter (e.g., a matter of seconds). As with the predetermined event described above with respect to step 102, the event here may comprise one or a combination of, for example, the engine of the vehicle being turned off, the vehicle doors being locked, or any other suitable or appropriate event. Telematics unit 30 may be further configured to acquire a second measurement of the signal strength corresponding to a time that is subsequent to that corresponding to the first measurement. More particularly, the second signal strength measurement may correspond to a time that is a predetermined amount of time subsequent to the occurrence of the event to which the first measurement corresponds, or a time corresponding to the occurrence of a second, different event. For example, if the first measurement corresponds to a time at which the engine of the vehicle was turned off, the second measurement may correspond to a time that is a certain amount of time after the engine was turned off (e.g., a matter of seconds or minutes) or to a time at which another event occurs, such as, for example, the vehicle doors being locked, a smart key for the vehicle being removed from the vehicle and, in at least certain instances, being more than a certain distance from the vehicle, or any other appropriate event. In any instance, telematics unit 30 may be configured to acquire the first and second signal strength measurements by measuring one or both them itself or obtaining it or them from a memory device thereof (e.g., memory device 54), or by obtaining one or both measurements from another component of vehicle electronics 28 of vehicle 12.

Regardless of how they are acquired, once the first and second signal strength measurements are acquired, telematics unit 30 is configured to compare them to each other and to determine whether electronic device 57 is located at the vehicle (e.g., within or in close proximity vehicle 12) based on that comparison. For example, if the comparison reveals that the second measurement is greater than, or, in certain embodiments, equal to or greater than, the first measurement, telematics unit 30 can determine that electronic device 57 is still in close proximity to telematics unit 30 or a particular component thereof (i.e., antenna), and thus, can further determine or detect that electronic device 57 is located at vehicle 12. Alternatively, if the comparison reveals that the second measurement is less than (and in certain instances, a particular empirically-derived amount less than) the first measurement, telematics unit 30 can determine that electronic device 57 has moved away from telematics unit 30 or a particular component thereof (i.e., antenna), and thus, can further determine or detect that electronic device 57 is no longer located at vehicle 12.

In yet still another embodiment, step 104 may comprise using the signal strength of the wireless connection to determine a distance between electronic device 57 and, for example, telematics 30 or another component of vehicle 12, and then using that distance to determine whether electronic device 57 is located at vehicle 12. More specifically, a received signal strength indication (RSSI) of the signal between telematics unit 30 and electronic device 57 may be computed or otherwise determined by, for example, telematics unit 30 using techniques well known in the art. The RSSI may then be used to interpolate an estimated distance between telematics unit 30 and electronic device 57 in accordance with known techniques. If the estimated distance is more than a predetermined threshold distance, a determination can be made that electronic device 57 is not located at (e.g., within or in close proximity to) vehicle 12. Conversely, if the distance is less than the predetermined threshold, a determination can be made that vehicle 12 is located at vehicle 12. In such an embodiment, the threshold distance may be a fixed threshold value that is empirically derived during, for example, design, manufacture, or installation of vehicle 12 or telematics unit 30 thereof, and programmed into in a memory device of telematics unit 30 (e.g., memory 54) or in another memory device that is accessible thereby. In another embodiment, the threshold distance may be an adjustable value that may be selected by the user (e.g., using, for example, a user interface of vehicle electronics 28, the user may select from a number of predetermined threshold values, or alternatively, may input a particular threshold value). In such an embodiment the process of detecting whether electronic device 57 is located within the vehicle may therefore be a calibratable one.

Accordingly, it will be appreciated in view of the foregoing that any number of techniques may be used to determine or detect whether electronic device 57 remains at vehicle 12 following a determination that the vehicle occupant has exited vehicle 12, including, but not limited to, those expressly described above. Therefore, it will be appreciated that step 104 is not limited to the use of any particular technique(s) to do so.

If it is determined in step 104 that a suitably configured electronic device (e.g., electronic device 57) is located at the vehicle, and therefore, was left there when the occupant exited the vehicle, method 100 moves to step 106 comprising generating one or more alerts to notify the occupant of this fact. In one embodiment, step 106 may be performed by the vehicle electronics 28 and, in an embodiment, telematics unit 30 (i.e., electronic processing device 52), in particular. In another embodiment, and as will be described more fully below, step 106 may be performed by vehicle electronics 28 (e.g., telematics unit 30) in conjunction with one or more other devices or components of vehicle 12. In either instance, step 106 may be performed in a number of ways.

For example, in an embodiment, step 106 comprises generating an auditory alert indicative of electronic device 57 being located at the vehicle. This may comprise, for example, telematics unit 30 either directly or indirectly (e.g., through a VSM 42 such as a body control module) controlling a component of vehicle 12, such as the horn, a speaker, audio system 36, or another suitable display device to display or output a particular auditory alert outside or external to vehicle 12. The alert may comprise a verbal message (e.g., "you left your phone at the car"), a distinct combination of sounds (e.g., the honking of the horn a certain number of times or for a certain length of time; one or more beeps or other sounds/noises using, for example, a security system of the vehicle; etc.); or any other suitable alert/notification. In any event, telematics unit 30 may be configured to generate a command to cause the alert to be displayed, which may include, for example, acquiring the command from a memory device thereof, such as memory 54, or from another memory device accessible thereby.

In another embodiment, in addition to or instead of an auditory alert, step 106 comprises generating a visual alert that is indicative of electronic device 57 being located at vehicle 12. This may comprise, for example, telematics unit 30 either directly or indirectly (e.g., through a VSM 42 such as a body control module) controlling a component of the vehicle, such as, for example, the headlights, brake lights, tail lights, interior lights, etc., to display or output a particular visual alert outside or external to vehicle 12. The alert may comprise a sequence of flashes of one or more lights of the vehicle, one or more lights of the vehicle turning "on" and/or remaining "on" for a predetermined period of time, or any other suitable visual alert. In any event, telematics unit 30 may be configured to generate a command to cause the alert to be displayed, which may include acquiring the command from a memory device thereof, such as memory 54, or from another memory device accessible thereby.

In yet another embodiment, in addition to or instead of one or more of the auditory and visual alerts described above, step 106 comprises generating a message indicative of electronic device 57 being located or left at vehicle 12 and transmitting the message to a particular person registered or associated with the telematics unit 30 or vehicle 12, which may not necessarily be the occupant who exited the vehicle. This may comprise telematics unit 30 generating or acquiring from a memory device, such as memory 54, an electronic mail message, text message, or automated recording advising the recipient that electronic device 57 was left at the vehicle and then transmitting it to one or more predetermined email addresses or telephone numbers (e.g., mobile phone, pager, office phone, home phone, etc.) via, for example, communications network 14. Alternatively, the message may originate from call center 20 in response to telematics unit 30 determining that the occupant has exited the vehicle and that electronic device 57 is located within the vehicle.

In an embodiment, method 100 may optionally comprise looping back to step 104 a predetermined amount of time following the performance of step 106 to determine whether electronic device 57 still remains at the vehicle or whether the occupant has since retrieved it following the display of the alert. In such an embodiment, if it is determined in the second iteration of step 104 that electronic device 57 remains at the vehicle, step 106 may be repeated with the same, additional, or altogether different alerts being generated. For example, if a visual alert was issued the first time step 106 was performed, an auditory alert and/or a message may be generated the second time step 106 is performed since it may be assumed the occupant is further away from the vehicle than s/he was when the visual alert was generated, and thus, an auditory alert and/or message may be more effective than a visual alert. The looping back to step 104 following the performance of step 106 may be performed any number of times with the same or different alerts being generated in each iteration. Accordingly, in an embodiment, different alerts may be sequenced to be generated at different times rather than generating them all at the same time. The predetermined amount of time between the performance of step 106 and the looping back to step 104, which may be on the order of a number of seconds to a few minutes (e.g., 5 minutes), may be a default, non-adjustable time that is programmed into telematics unit 30 at the time of manufacture or installation, or may be defined and/or adjusted by a user through, for example, microphone 32, pushbuttons/control inputs 34, visual display 38, or any other suitable user interface device.

While a number of different types of alerts have been described in detail herein, step 106 is not limited to the generation of any one particular alert(s) or combinations of alerts, but rather step 106 may comprise generating any number of alerts or combinations of alerts, including, but not limited to, those described above, depending, at least in part, on the particular arrangement and configuration of vehicle 12.

In view of the foregoing, it will be appreciated that in order for method 100 to be beneficial to an occupant of the vehicle, steps 104 and 106 should be performed in a relatively short period of time (e.g., a matter of seconds and no longer than a few minutes or so) following the determination in step 102 that the occupant has exited the vehicle. More specifically, in one embodiment, in order for the described methodology to be useful it is desirable to notify the occupant before s/he is too far away from the vehicle to receive (e.g., hear and/or see) the alert such that the occupant does not have far to go to retrieve the device.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of providing an alert that a portable electronic device configured to be wirelessly connected to a device of the vehicle has been left at a vehicle, comprising the steps of:

(a) determining that an occupant has exited the vehicle;

(b) acquiring a measurement of the signal strength of a wireless connection between the portable electronic device and the vehicle device and detecting that the portable electronic device is located at the vehicle based at least in part on the acquired signal strength measurement; and (c) generating an alert to notify the occupant that the electronic device has been left at the vehicle.

2. The method of claim 1, wherein step (a) comprises determining that the occupant has left the vehicle in response to the occurrence of a predetermined event.

3. The method of claim 2, wherein the predetermined event comprises at least one of:

the vehicle being turned off;

the vehicle doors being locked;

the vehicle being turned off and a predetermined amount of time having elapsed without the vehicle being re-started or the occupant re-entering the vehicle; and a smart key for the vehicle being removed from the vehicle.

4. The method of claim 1, wherein the acquired signal strength measurement is a first acquired signal strength measurement corresponding to a time at which a predetermined event occurs, and step (b) further comprises acquiring a second measurement of the signal strength of the wireless connection corresponding to a time subsequent to the time corresponding to the first measurement;

comparing the first and second measurements and determining whether the electronic device is located at the vehicle based on the comparison.

5. The method of claim 4, wherein the second measurement corresponds to a time that is at least one of:

a time that is a predetermined amount of time subsequent to the occurrence of the predetermined event; and a time at which another predetermined event occurs.

6. The method of claim 4, wherein the predetermined event comprises the turning off of the vehicle and the second measurement corresponds to a time that is at least one of a time that is a predetermined amount of time subsequent to the vehicle being turned off;

a time at which the vehicle is locked; and a time at which a smart key for the vehicle is removed from the vehicle.

7. The method of claim 1, wherein step (b) comprises detecting that the electronic device is located at the vehicle when the signal strength measurement is greater than a predetermined minimum signal strength.

8. The method of claim 1, wherein step (c) comprises generating at least one of:

an auditory alert indicative of the electronic device being left at the vehicle;

a visual alert indicative of the electronic device being left at the vehicle; and a message indicative of the electronic device being left at the vehicle.

9. A method of providing an alert that a portable electronic device has been left at a vehicle, comprising the steps of:

(a) determining that an occupant has exited the vehicle;

(b) detecting that a portable electronic device is electrically connected to an electromechanical port disposed within the vehicle and thus that the portable electronic device is located at the vehicle; and (c) generating an alert to notify the occupant that the electronic device has been left at the vehicle.

10. A system for providing an alert that a portable electronic device configured to be wirelessly connected to a device of the vehicle has been left at a vehicle, comprising an electronic processing device configured to:

(a) determine that an occupant has exited the vehicle;

(b) acquire a measurement of the signal strength of a wireless connection between the portable electronic device and the vehicle device and to detect that the portable electronic device is located at the vehicle based at least in part on the acquired signal strength measurement; and (c) generate an alert to notify the occupant that the electronic device has been left at the vehicle.

11. The system of claim 10, wherein the electronic processing device is configured to determine that an occupant has exited the vehicle in response to the occurrence of a predetermined event.

12. The system of claim 11, wherein the predetermined event comprises at least one of:

the vehicle being turned off;

the vehicle doors being locked;

the vehicle being turned off and a predetermined amount of time having elapsed without the vehicle being re-started or the occupant re-entering the vehicle; and a smart key for the vehicle being removed from the vehicle.

13. The system of claim 10, wherein the acquired signal strength measurement is a first acquired signal strength measurement corresponding to a time at which a predetermined event occurs, and the electronic processing device is further configured to:

acquire a second measurement of the signal strength of the wireless connection between the electronic device and the vehicle device corresponding to a time subsequent to the time corresponding to the first measurement;

compare the first and second measurements; and determine whether the electronic device is located at the vehicle based on the comparison of the first and second measurements.

14. The system of claim 13, wherein the vehicle device comprises the electronic processing device.

15. The system of claim 13, wherein the second measurement corresponds to a time that is at least one:

a time that is a predetermined amount of time subsequent to the occurrence of the predetermined event; and a time at which another predetermined event occurs.

16. The system of claim 13, wherein the predetermined event comprises the turning off of the vehicle and the second measurement corresponds to a time that is at least one of:

a time that is a predetermined amount of time subsequent to the vehicle being turned off;

a time at which the vehicle is locked; and a time at which a smart key for the vehicle is removed from the vehicle.

17. The system of claim 10, wherein the electronic processing device is configured to detect that the electronic device is located at the vehicle when the signal strength measurement is greater than a predetermined minimum signal strength.

18. The system of claim 17, wherein the vehicle device comprises the electronic processing device.

19. The system of claim 10, wherein the electronic processing device is configured to generate an alert by at least one of:

generating an auditory alert indicative of the electronic being left at the vehicle;

generating a visual alert indicative of the electronic device being left at the vehicle; and generating a message indicative of the electronic device being left at the vehicle.

20. A system for providing an alert that a portable electronic device has been left at a vehicle, comprising an electronic processing device configured to:

(a) determine that an occupant has exited the vehicle;

(b) detect that a portable electronic device is located at the vehicle by detecting that the electronic device is electrically connected to an electromechanical port disposed within the vehicle; and (c) generate an alert to notify the occupant that the electronic device has been left at the vehicle.

* * * * *